US006515590B1

(12) United States Patent
Lauria

(10) Patent No.: US 6,515,590 B1
(45) Date of Patent: Feb. 4, 2003

(54) BOOK ORGANIZING DEVICE

(76) Inventor: James Lauria, 1615A Arch St., Berkeley, CA (US) 94709

( * ) Notice: Subject to any disclaimer, the term of this patent is extended or adjusted under 35 U.S.C. 154(b) by 0 days.

(21) Appl. No.: 09/525,666

(22) Filed: Mar. 15, 2000

(51) Int. Cl.[7] ..... G08B 25/08

(52) U.S. Cl. ..... 340/692; 340/545.3; 340/546.6; 340/691.1; 211/51; 211/59.3; 221/279

(58) Field of Search ..... 340/692, 555, 340/556, 557, 545.3, 545.4, 545.5, 546.6, 691.1; 211/42, 43, 59.3, 184, 51; 312/249.1; 221/279

(56) References Cited

U.S. PATENT DOCUMENTS 5,217,122 A * 6/1993 Martinez ..... 211/43
5,730,320 A * 3/1998 David ..... 221/279
5,788,091 A * 8/1998 Robertson et al. ..... 211/59.2
5,833,076 A * 11/1998 Harres et al. ..... 211/51
6,142,317 A * 11/2000 Merl ..... 211/59.3

* cited by examiner

*Primary Examiner*—Daniel J. Wu
*Assistant Examiner*—Davetta W. Goins
(74) *Attorney, Agent, or Firm*—Carol D. Titus; Gregory Smith & Associates

(57) ABSTRACT

Book Organizing Device with A flat, horizontally disposed shelf like member, a fixed, vertical end panel attached to one end of the shelf member, a slidable vertical panel having a constant force spring centrally attached under the shelf member, the slidable vertical panel exerting approximately one pound of force inwardly towards the fixed end panel, the constant force spring having an encoder ring mounted to the spring reel, a photo diode placed to read said encoder ring that provides a signal any time said ring is rotated, said signal triggering one of a plurality of short recorded messages to be broadcast from a speaker located on the underside of said book shelf, said messages being stored and selected by a digital programmable microprocessor designed for such purposes, and Said shelf member also having a rear book retaining bracket to prevent books from being pushed too far to the rear of the shelf.

7 Claims, 3 Drawing Sheets

BOOK ORGANIZING DEVICE

BACKGROUND OF THE INVENTION

This invention relates generally to the field of book shelves, and more particularly to a book organizing device for children Book shelves of various types are known. Children's book shelves tend to become disorderly rather quickly because of the young child's inability to put books back neatly.

Additionally, parents generally want their children to read and to look forward to the activity of reading.

Book shelves currently available for children's rooms do little to help reduce book clutter and offer no incentives in and of themselves to cause the child to want to pull out or return a book.

SUMMARY OF THE INVENTION

The primary object of the invention is to provide a device that keeps a plurality of books in a neat and upright position regardless of the number of books stored in the device.

Another object of the invention is to provide a book retaining device that emits an audible reinforcing message every time a book is taken out or replaced.

Other objects and advantages of the present invention will become apparent from the following descriptions, taken in connection with the accompanying drawings, wherein, by way of illustration and example, an embodiment of the present invention is disclosed.

Book Organizing Device comprising: A flat, horizontally disposed shelf like member, a fixed, vertical end panel attached to one end of said shelf member, a slidable vertical panel having a constant force spring centrally attached under said shelf member, said slidable vertical panel exerting approximately one pound of force inwardly towards said fixed end panel, said constant force spring having an encoder ring mounted to the spring reel, a photo diode placed to read said encoder ring that provides a signal any time said ring is rotated, said signal triggering one of a plurality of short recorded messages to be broadcast from a speaker located on the underside of said book shelf, said messages being stored and selected by a digital programmable microprocessor designed for such purposes, and Said shelf member also having a rear book retaining bracket to prevent books from being pushed too far to the rear of the shelf.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
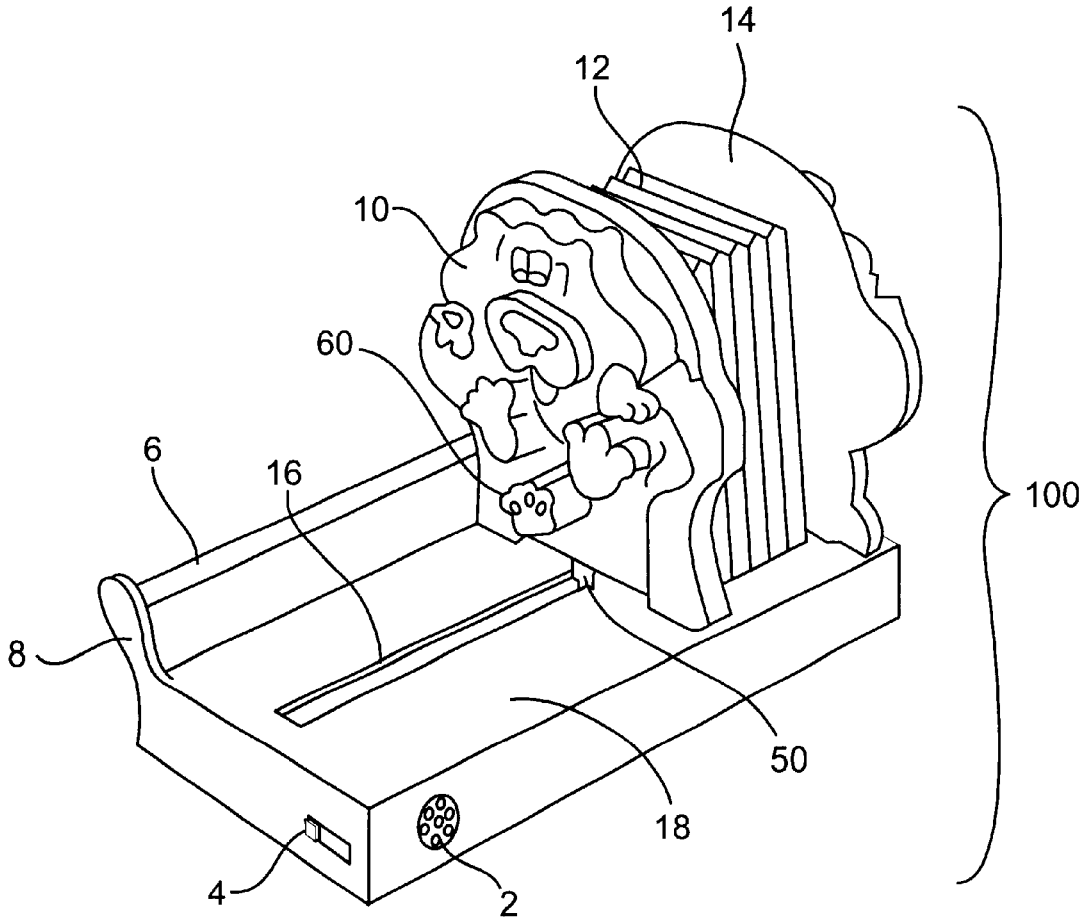
FIG. 1 is a perspective view of the book retaining device of the present invention.

Now to FIG. 1, we see a perspective view of the book organizer of the present invention 100. Flat shelf portion 18 has slot 16 centrally located. A pair of book retaining brackets 10, 14 hold books 12 in place. Bracket 14 is fixed. Bracket 10 is movable and is inwardly sprung to hold books in an upright position. Tab 50 extends below shelf 18 and is attached to a linear bearing 52. The user can pull out bracket 10 by pulling on protruding member 60. Back support member 6 keeps books from being pushed too far in. Switch 4 turns on the audio portion of the invention. Speaker grill 2 allows voice or music to emanate from the unit.

Figure 2:
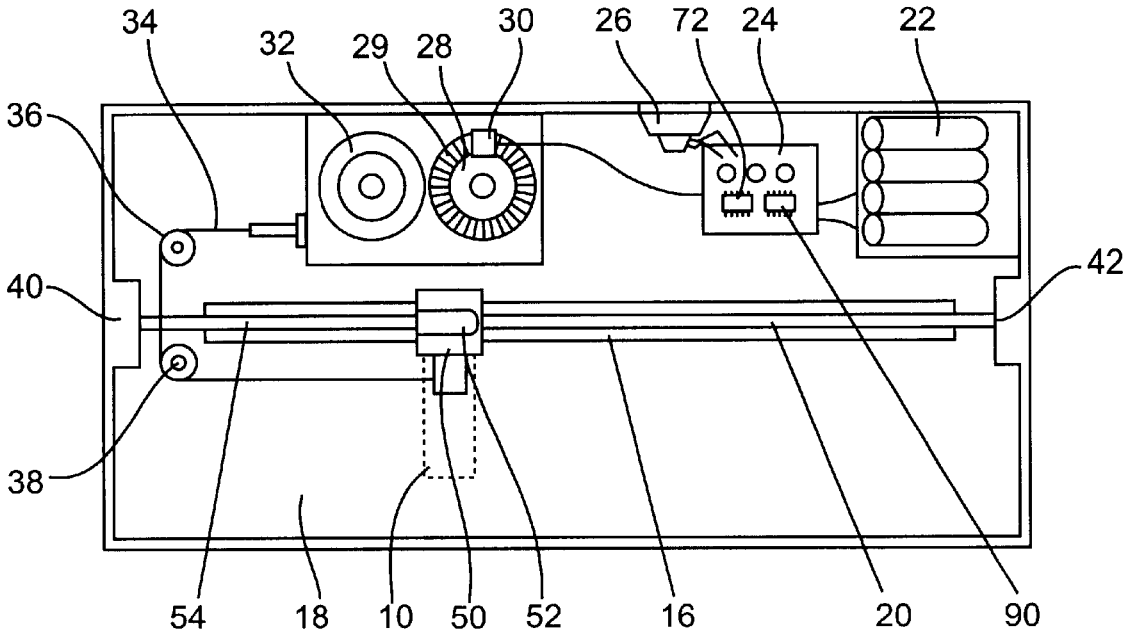
FIG. 2 is an underside or bottom view of the book retaining device of the present invention.
Figure 3:
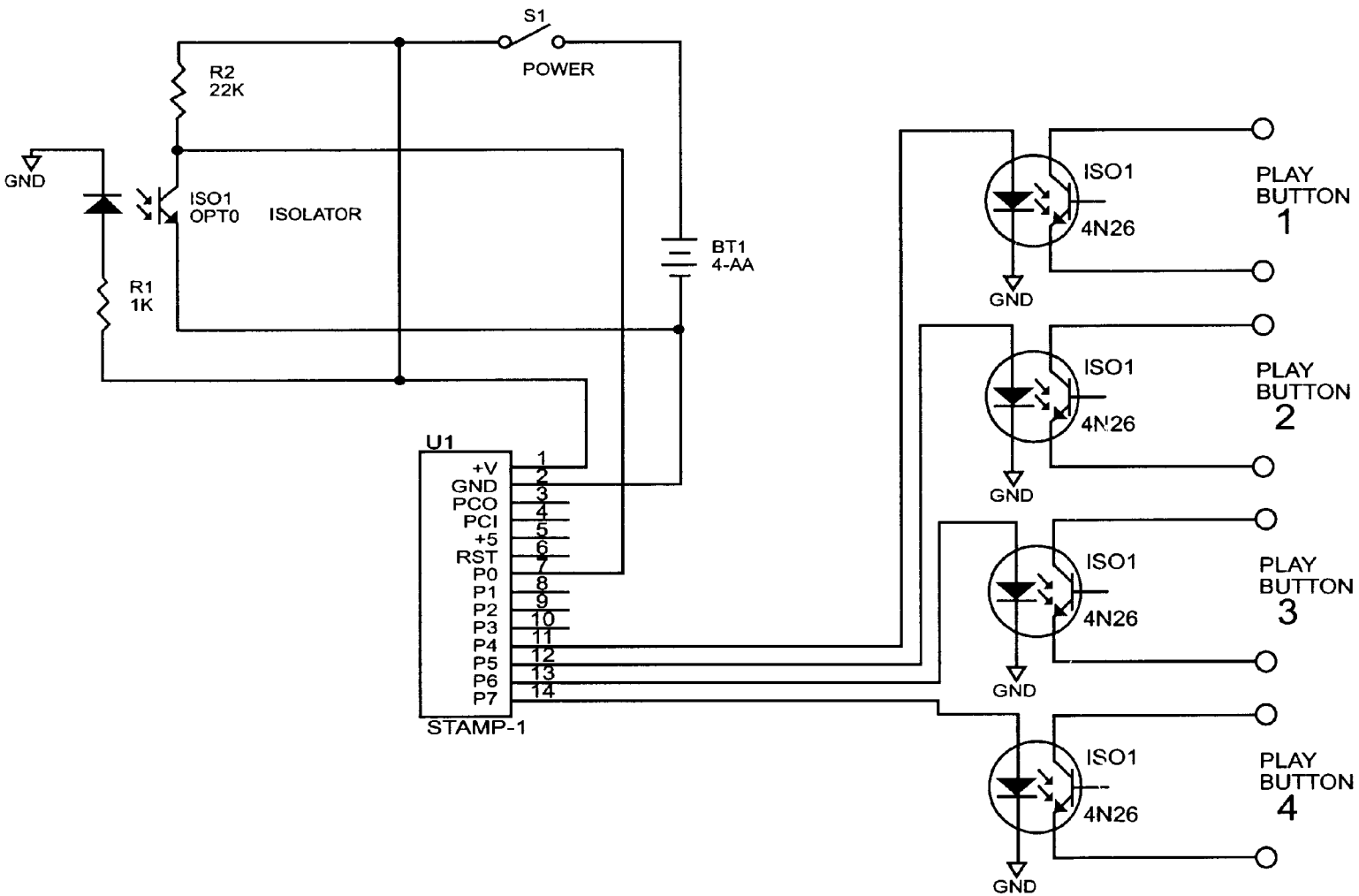
FIG. 3 is a schematic drawing of the circuit of the present invention.

Now to FIG. 2, we see an underside view of the present invention. Linear bearing 52 slides on shaft 4 thereby causing tab 50 and associated bracket 10 to move. Wire 34 extends from spring reel 32 and is attached to sliding tab 50. When the user slides bracket 50 to insert or remove a book, the spring reels 32 and 28 turn and an inward pressure of about one pound is exerted on tab 50. Pulleys 38, 36 allow the spring reel to be placed in a position that allows maximum travel of slidable bracket 50, from fully closed to fully open. Additionally, reel 28 has an optical encoder built onto it and when any rotation occurs due to the insertion or removal of a book, the encoder sends a message to microprocessor 90 which in turn activates voice or music message that is stored in digital chip 92. The audio portion of the device is powered by batteries 22. One embodiment of the present invention can include the ability of the user to record his or her own messages in the digital record and playback chips as opposed to having the messages pre programmed into the device. The voice or music is made audible by speaker 26. FIG. 3 is a schematic view of the circuit of the present invention. In this way, when a person removes or replaces a book, he or she is greeted with an encouraging message. Additionally, the automatic spring return of the slidable bracket means that books will always be kept in a neat vertical position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A book organizing device, comprising:

a flat shelf having a first end, a second end, a back edge and a front edge, a slot centrally located within said flat shelf, a fixed book retaining bracket located at said first end, a movable book retaining bracket having a bottom and having a decorative appearance, a tab extending from said bottom of said movable book retaining bracket and extending at least partially through said slot, a back support member located proximate said back edge of said flat shelf and having a height less than half of a height of said fixed book retaining bracket, a linear bearing assembly located below said flat shelf, said linear bearing assembly including:

a shaft, a linear bearing located on said shaft and attached to said tab, a spring reel, a wire connecting said spring reel and said tab, at least one pulley attached to a said flat shelf, said wire engaging said at least one pulley, an optical encoder connected to said spring reel, a photo diode located to read said optical encoder such that when said spring reel is rotated, said optical encoder activates said photo diode thereby sending an electronic message, a speaker connected to said flat shelf, a microprocessor designed to receive said electronic message and activate an encouraging audio recording playable on said speaker, and a switch electronically connected to said microprocessor, wherein said book organizing device is open adjacent said front edge of said flat shelf.

2. The book organizing device of claim 1, wherein said encouraging audio recording is one of a plurality of encouraging audio recordings.

3. The book organizing device of claim 1, wherein said movable book retaining bracket is shaped to resemble a character.

4. The book organizing device of claim 1, wherein said movable book retaining bracket is shaped to resemble an imaginary character.

5. The book organizing device of claim 1, further comprising means for recording said encouraging audio message.

6. The book organizing device of claim 1, wherein said movable book retaining bracket exerts approximately one pound of force inwardly towards said fixed book retaining bracket.

7. The book organizing device of claim 1, further comprising a graspable protruding member attached to said movable book retaining bracket.

* * * * *